US011516593B2

(12) United States Patent
Zhang

(10) Patent No.: US 11,516,593 B2
(45) Date of Patent: Nov. 29, 2022

(54) MULTIPOLE ENGINE ARRAY SYSTEM AND LOUDSPEAKER

(71) Applicants: Yongchun Zhang, Heilongjiang (CN); Shenzhen Xinqi Science and Technology Co., Ltd., Shenzhen (CN)

(72) Inventor: Yongchun Zhang, Heilongjiang (CN)

(73) Assignee: Shenzhen Xinqi Science and Technology Co., Ltd., Shenzhen (CN)

( * ) Notice: Subject to any disclaimer, the term of this patent is extended or adjusted under 35 U.S.C. 154(b) by 18 days.

(21) Appl. No.: 17/270,249

(22) PCT Filed: Aug. 6, 2019

(86) PCT No.: PCT/CN2019/099446
§ 371 (c)(1),
(2) Date: Feb. 22, 2021

(87) PCT Pub. No.: WO2020/038228
PCT Pub. Date: Feb. 27, 2020

(65) Prior Publication Data

US 2021/0337314 A1 Oct. 28, 2021

(30) Foreign Application Priority Data

Aug. 23, 2018 (CN) ..... 201810964270.2

(51) Int. Cl.
*H04R 9/06* (2006.01)
*H04R 1/02* (2006.01)
(Continued)

(52) U.S. Cl.
CPC ..... *H04R 9/063* (2013.01); *H04R 1/02* (2013.01); *H04R 1/403* (2013.01); *H04R 9/025* (2013.01); *H04R 2400/11* (2013.01)

(58) Field of Classification Search
CPC ..... H04R 9/063; H04R 1/02; H04R 1/403; H04R 9/025; H04R 2400/11
See application file for complete search history.

(56) References Cited

U.S. PATENT DOCUMENTS

2007/0297639 A1 12/2007 Noll
2013/0051604 A1 2/2013 Sakai
(Continued)

FOREIGN PATENT DOCUMENTS

CN 2598291 Y 1/2004
CN 1493168 A 4/2004
(Continued)

OTHER PUBLICATIONS

Extended European Search Report dated Sep. 13, 2021 received in European Patent Application No. EP 19853132.9.
(Continued)

*Primary Examiner* — Sunita Joshi
(74) *Attorney, Agent, or Firm* — Scully Scott Murphy & Presser

(57) ABSTRACT

The present invention provides a multipole engine array system and a loudspeaker, the multipole engine array system comprising a plurality of engine assemblies distributed in an annular array, the plurality of engine assemblies being fixed inside the cylindrical loudspeaker by means of a mounting base provided in a housing of the cylindrical loudspeaker; each engine assembly comprises a magnetic conduction plate and a magnet provided in the magnetic conduction plate; a magnetic field is formed between the magnet and the magnetic conduction plate; and the plurality of engine assemblies are arranged coaxially and annularly along the periphery of the mounting base, so as to form a multipole magnetic field having a plurality of magnetic pole directions. In the present invention, a multipole magnetic field enclosed by planes is formed by means of monopole equal-
(Continued)

magnetic-plane magnetic fields in a multipole way, such that each pole face of an inductive diaphragm radiates sound waves with controllable power to any settable angular space at different angles; the diaphragms are driven to vibrate at the same time, so as to form more audio information, improving the power and efficiency of the loudspeaker, and increasing the response speed.

10 Claims, 6 Drawing Sheets

(51) Int. Cl.
*H04R 1/40* (2006.01)
*H04R 9/02* (2006.01)

(56) References Cited

U.S. PATENT DOCUMENTS

| | | | | |
|---|---|---|---|---|
| 2015/0010195 | A1 | 1/2015 | Croft, III | |
| 2018/0091896 | A1* | 3/2018 | Stanley | F21V 33/0056 |
| 2020/0053467 | A1 | 2/2020 | Sato et al. | |

FOREIGN PATENT DOCUMENTS

| | | | |
|---|---|---|---|
| CN | 101815233 | A | 8/2010 |
| CN | 205610919 | U | 9/2016 |
| CN | 106210997 | A | 12/2016 |
| CN | 108924713 | A | 11/2018 |
| CN | 108966097 | A | 12/2018 |
| JP | S57-34772 | B2 | 7/1982 |
| JP | H08-102988 | A | 4/1996 |
| JP | 2003-032787 | A | 1/2003 |
| JP | 2004-180193 | A | 6/2004 |
| JP | 2014-533455 | A | 12/2014 |
| JP | 63-26649 | B1 | 5/2018 |
| KR | 101778295 | B1 | 9/2017 |

OTHER PUBLICATIONS

Notice of Reasons for Refusal dated Mar. 14, 2022 received in Japanese Patent Application No. JP 2021-534417 together with an English language translation.
International Search Report dated Oct. 29, 2019 received in International Application No. PCT/CN2019/099446.

* cited by examiner

MULTIPOLE ENGINE ARRAY SYSTEM AND LOUDSPEAKER

TECHNICAL FIELD

The present disclosure relates to the technical field of dynamic loudspeakers, in particular to a multipole engine array system and a loudspeaker.

BACKGROUND

Traditional mid-and-tweeter loudspeaker units generally include cone loudspeakers, dome loudspeakers, horn loudspeakers, ribbon loudspeakers, and planar loudspeakers. Wavefronts of radiated waves of the cone loudspeaker, the dome loudspeaker and the horn loudspeaker are spherical waves. Wavefronts of the spherical waves change sharply from the center to the edge. A driving force generated by a voice coil is not laid flat on a membrane; instead, it is first transmitted to the edge of the membrane (the center of the membrane for individual mid-range loudspeakers), and then gradually transmitted to other parts of the entire membrane, which will necessarily take a certain amount of time. Therefore, the forces on various parts of the membrane will be uneven at a certain moment, and it is impossible to react quickly with the driving force of the voice coil at the same moment, which will cause distortion and delay of the membrane.

The wavefronts of the radiated waves of ribbon loudspeakers and planar loudspeakers are plane waves. According to the characteristics of plane waves, the amplitude and phase of all particles on the plane perpendicular to the propagation direction are each equal (similar to parallel light), which is recognized as the ideal radiation manner with the lowest degree of distortion. Although the degree of distortion of plane waves is low, the diffusion ability beyond the range of the wavefronts is obviously insufficient, and the off-axis directivity drops sharply. Plane waves almost always radiate sound waves directly forwardly of the loudspeaker. When the radiation angle is greater than 120° (plus or minus 60°), the level of diffused radiation will deteriorate sharply, and the uniform radiation of 180°-360° cannot be achieved. Although some ribbon tweeters and high-end electrostatic tweeters belong to dipoles, and their back sides can also radiate sound, but because the sound waves on the front side and back side are antiphase, the phase difference is 180°, so the use value is not high.

The membrane and voice coil (circuit) of the existing ribbon tweeter loudspeakers are generally of an integral structure and equipped with a dedicated transformer. The upper limit of the high frequency of this kind of loudspeaker can be higher than that of dome tweeters, and the characteristic of its wavefronts being plane waves also makes its sound quality have a low degree of distortion in some cases. However, the size and mass of the membrane have a great influence on the frequency, the frequency band is not wide enough, and it is difficult to achieve a resonant frequency below 2000 Hz. At the same time, since the wavefronts of the ribbon tweeter loudspeakers are plane waves, the directivity is very narrow.

An air motion tweeter is a special isomagnetic ribbon tweeter. It is also made of a very thin film (PI) material with a metal circuit printed on it. The membrane and voice coil are also integral, which differs from the ribbon tweeter in that the membrane is made into a wrinkle shape transversely, and adjacent membrane wrinkles are squeezed transversely to eject airflow radiated sound waves. The upper limit of the high frequency is also similar to the ribbon tweeter, and the frequency width is better than the ribbon tweeter. However, due to its special membrane wrinkle structure, it does not directly radiate sound waves forward, but transversely squeezes and ejects airflow radiated sound waves. Such ejected airflow will generate air vortex and form additional airflow sound and standing waves. In addition, the sound waves are in a state of transverse squeeze and collision, which causes phase distortion when sound waves of the same wavelength collide, whereas harmonic distortion occurs when high-order harmonics of integer multiples collide.

SUMMARY

An object of the present disclosure is to at least solve one of the above-mentioned defects and shortcomings, and the object is achieved through the following technical solutions.

The present disclosure provides a multipole engine array system, which is applied to a cylindrical loudspeaker and includes a plurality of engine assemblies distributed in an annular array, the plurality of engine assemblies being fixed inside the cylindrical loudspeaker through a mounting seat arranged in a housing of the cylindrical loudspeaker, wherein each of the engine assemblies includes a magnetic conduction plate and a magnet arranged in the magnetic conduction plate, a magnetic field is formed between the magnet and the magnetic conduction plate, and the plurality of the engine assemblies are arranged coaxially and annularly along a periphery of the mounting seat to form a multipole magnetic field with multiple magnetic pole directions.

Further, the plurality of the engine assemblies are separated from one another, and magnetic pole faces of the plurality of the engine assemblies are on different planes respectively. Further, the magnetic conduction plate is a U-shaped magnetic conduction plate, at least one said magnet is arranged in the magnetic conduction plate, and a U-shaped opening of the magnetic conduction plate faces a membrane of the cylindrical loudspeaker. An end face of one end of the magnet is attached to a U-shaped bottom surface of the magnetic conduction plate, and an end face of the other end of the magnet corresponds to an inner surface of the membrane at a certain distance. There is a certain gap between the magnet and inner walls of extending portions on both sides of the magnetic conduction plate, and the magnetic field formed between the magnet and the magnetic conduction plate is an isomagnetic plane magnetic field.

Further, one said magnet can form two magnetic circuits with the magnetic conduction plate, and N said magnets can form N+1 magnetic circuits with the magnetic conduction plate.

Further, the mounting seat is of a polygonal prism structure, and includes a plurality of first cylindrical surfaces provided with the membrane and a second cylindrical surface not provided with the membrane, wherein the membrane surrounds the periphery of the mounting seat to form a polygonal prism-like membrane with a plurality of pole faces, the engine assemblies are installed between the first cylindrical surfaces and a back side of the membrane, the first cylindrical surfaces are provided with a U-shaped mounting groove matching the engine assemblies, the back side of the magnetic conduction plate of the engine assembly is attached to the surface of the U-shaped mounting groove, and the magnetic pole faces of the engine assemblies correspond to the back side of membrane.

Further, a circuit is printed on the membrane, and the pole faces are connected to each other through the circuit.

Further, each of the pole faces is a plane, vibrations of the pole faces of the membrane in different planes can form plane waves spreading in different directions, and the plane waves can be coupled with each other to form a multipole coupled plane wave.

Further, a back plate is fixedly installed on the second cylindrical surface, a lead wire interface is provided on the back plate, and the lead wire interface is connected to an input end and an output end of the circuit printed on the membrane respectively.

Further, at least three engine assemblies are provided.

The present disclosure also provides a loudspeaker, which includes a cylindrical housing and the above-mentioned multipole engine array system installed in the cylindrical housing, wherein the loudspeaker is a tweeter loudspeaker and/or a mid-range loudspeaker.

The present disclosure has the following advantages:

(1) The multipole engine array system of the present disclosure can form a multipole magnetic field enclosed by planes from a single-pole isomagnetic plane magnetic field in a multipole manner, so that each pole face of the induction membrane respectively radiates sound waves with a controllable power to a 360° or a settable angle space in a manner of multi poles with different angles, thereby realizing the ability of complete diffusion of the spatial distribution.

(2) As compared with a single-pole engine, the present disclosure can drive the membrane to vibrate at the same time to form more audio information, and can perform high-power resolution on audio signals, thereby improving the power and efficiency of the loudspeaker.

(3) Since the multipole isomagnetic plane magnetic field generated by the multipole engine magnetic circuit structure can uniformly push the induction membrane, there is no distortion and delay caused by the transition of the membrane of traditional moving-coil loudspeaker from the part connected to the voice coil to other parts, which reduces the group delay of the loudspeaker, and makes the response speed faster.

BRIEF DESCRIPTION OF THE DRAWINGS

Upon reading a detailed description of preferred embodiments below, various other advantages and benefits will become clear to those skilled in the art. The drawings are only used for the purpose of illustrating the preferred embodiments, and should not be considered as limiting the present disclosure. Throughout the drawings, identical parts are denoted by identical reference signs.

REFERENCE SIGNS

Figure 1:
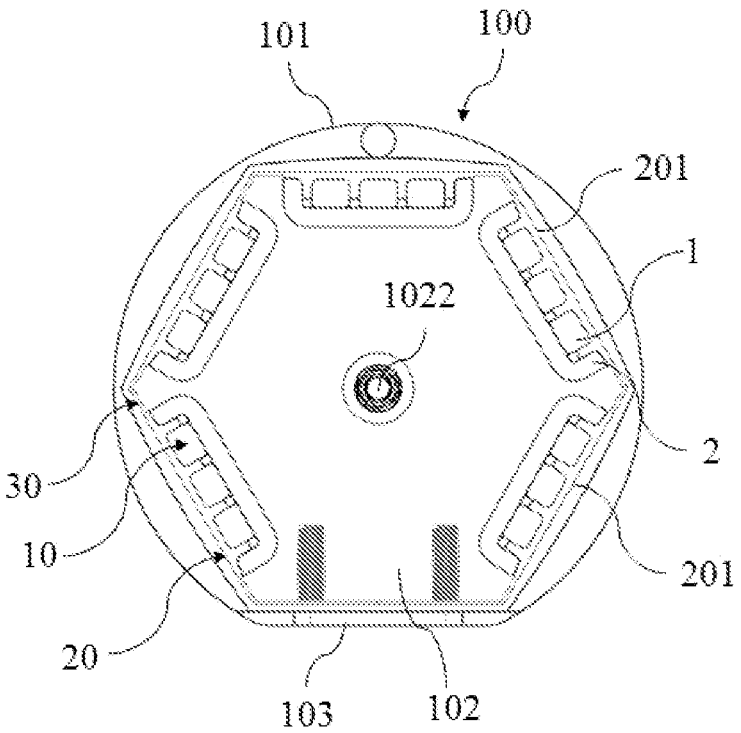
FIG. 1 is a schematic view of an assembled structure of a multipole engine array system provided by an embodiment of the present disclosure.
Figure 2:
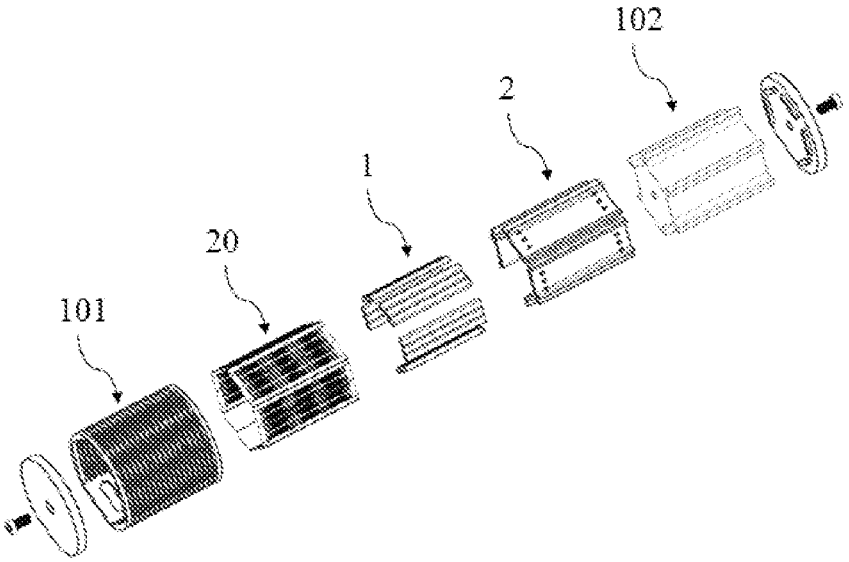
FIG. 2 is a schematic exploded view of the assembled structure of the multipole engine array system provided by the embodiment of the present disclosure.

100: loudspeaker; 10: engine assembly;
20: membrane; 30: PCB support plate;
101: housing; 102: mounting seat;
1021: mounting groove; 1022: through hole;
103: back plate; 201: pole face;
2011: first pole face; 2012: second pole face;
2013: third pole face;
1: magnet; 2: magnetic conduction plate;
11: first magnet; 12: second magnet;
13: third magnet; 21: bottom plate portion;
22: extending portion; 221: end face of extending portion;
31: first magnetic circuit; 32: second magnetic circuit;
33: third magnetic circuit; 34: fourth magnetic circuit.

DETAILED DESCRIPTION

Hereinafter, exemplary embodiments of the present disclosure will be described in more detail with reference to the accompanying drawings. Although exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

FIGS. 1 to 8 show schematic structural views of a multipole engine array system provided by an embodiment of the present disclosure. As shown in FIGS. 1 to 8, the multipole engine array system provided by the present disclosure is applied to a cylindrical loudspeaker 100, and includes a plurality of engine assemblies 10 arranged concentrically and distributed in an annular array. The plurality of engine assemblies 10 are separated from each other and located in different planes, and are fixed inside the cylindrical loudspeaker 100 through a mounting seat 102 arranged inside a housing 101 of the cylindrical loudspeaker 100. A central axis of the housing 101 coincides with a central axis of the mounting seat 102, and the mounting seat 102 is fixed inside the housing 101 through bolts. A periphery of the mounting seat 102 is covered with a membrane 20, and the engine assemblies 10 are installed between the membrane 20 and an outside face of the mounting seat 102.

The engine assembly 10 includes magnets 1 and a magnetic conduction plate 2. The magnetic conduction plate 2 is a U-shaped magnetic conduction plate and has an integrated structure. The U-shaped opening of the magnetic conduction plate 2 faces the membrane 20. The magnetic conduction plate 2 includes a bottom plate portion 21 and extending portions 22 located on both sides of the bottom plate portion 21, and the magnet 1 is installed on the bottom plate portion 21 of the magnetic conduction plate 2. An end face of one end (a lower end) of the magnet 1 is attached to an upper surface of the bottom plate portion 21, and an end face of the other end (an upper end) of the magnet 1 corresponds to an inner surface of the membrane 20 at a certain distance and is parallel with the inner surface. An end face 221 of the extending portion 22 and the end face of the other end (the upper end) of the magnet 1 form a magnetic pole face of the above engine assembly 10. The upper and lower ends of the magnet 1 are magnetic pole ends (N or S) of the magnet 1.

There is a certain gap between left and right sides (non-magnetic-pole ends) of the magnet 1 and inner walls of the extending portions 21 on both sides of the magnetic conduction plate 2 respectively, so that a planar magnetic field is formed between the magnet 1 and the magnetic conduction plate 2. The plurality of engine assemblies 10 are arranged coaxially and annularly along the periphery of the mounting seat 102 to form a multipole magnetic field with multiple magnetic pole directions. After the current is input, the membrane 20 can generate electromagnetic induction in the multipole magnetic field, which drives the membrane 20 to vibrate and emit a sound.

The mounting seat 102 is of a polygonal prism structure, and includes a plurality of first cylindrical surfaces provided with the membrane 20 and a second cylindrical surface not provided with the membrane 20. The membrane 20 surrounds the plurality of first cylindrical surfaces to form a polygonal prism-like membrane with a plurality of pole faces 201. Back sides of the pole faces 201 are attached to the outside surface of the mounting seat 102 through PCB support plates 30. The first cylindrical surfaces of the mounting seat 102 are provided with U-shaped mounting grooves 1021 that match the engine assemblies 10, back sides of the magnetic conduction plates 2 are attached to surfaces of the U-shaped mounting grooves 1021, and the magnetic pole faces of the engine assemblies 10 correspond to back sides of the pole faces 201 at a certain distance. A back plate 103 is fixedly installed on the second cylindrical surface, and a lead wire interface is provided on the back plate 103. The lead wire interface is connected to an input end and an output end of a circuit printed on the membrane 20 respectively. In a specific implementation, if the mounting seat 102 has a quadrilateral prism structure, it includes three first cylindrical surfaces and one second cylindrical surface, and the membrane 20 has three pole faces 201; if the mounting seat 102 has a hexagonal prism structure, it includes five first cylindrical surfaces and one second cylindrical surface, and the membrane 20 has five pole faces 201, that is, one cylindrical surface is always left on the mounting seat 102 for serving as the back plate 103. The mounting seat 102 may be a solid structure or a hollow structure.

Each pole face 201 of the polygonal prism-like membrane 20 is a plane, and each pole face 201 is in a different plane (that is, angles of the plurality of pole faces 201 are different from each other). Each pole face 201 is connected to another one through a printed circuit. After the audio current is input, an audio signal is input from a current input interface located on one side of the back plate 103 (the second cylindrical surface). The pole faces 201 vibrate in different directions to form plane waves that spread in different directions. The above plane waves in different directions can be coupled with each other to form a multipole coupled plane wave. The multipole coupled plane wave spreads in different directions to form cylindrical waves, which can reduce a collision airflow caused by the collision of air particles containing sound waves, reduce standing waves, and reduce distortion of the loudspeaker 100 caused by air collision.

Figure 3:
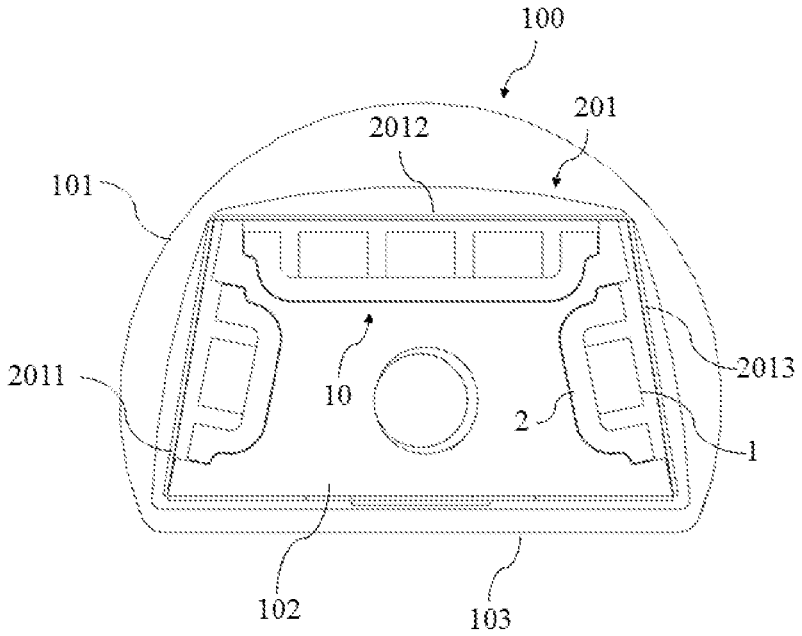
FIG. 3 is a schematic view of a multipole engine array system composed of three engine assemblies provided by an embodiment of the present disclosure.
Figure 4:
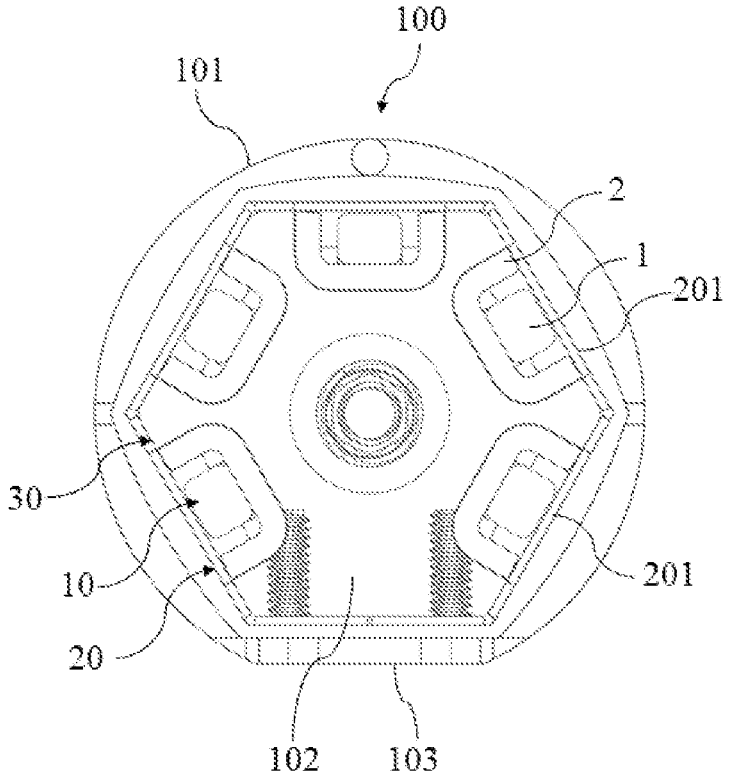
FIG. 4 is a schematic view of a multipole engine array system composed of five engine assemblies provided by an embodiment of the present disclosure.

The number of pole faces 201 of the membrane 20 and the size and shape of each pole face 201 may not be completely the same, that is, the cross-sectional shape of the membrane 20 may be a regular or irregular polygon. In a preferred implementation, the cross section of the membrane 20 is an even-numbered polygon such as a quadrilateral or a hexagon. The number of pole faces 201 (cylindrical surfaces) of the membrane 20 is the number of edges of the polygonal minus 1, and the number of engine assemblies 10 matches the number of the pole faces 201 of the membrane 20. For example, FIG. 3 shows a membrane with three pole faces 201 and a loudspeaker 100 with three engine assemblies 10, wherein the widths of the three pole faces 201 are different, and the numbers of magnets 1 in the three engine assemblies 10 are different. The first pole face 2011 and the third pole face 2013 have the same width and are provided with one magnet 1, and the second pole face 2012 has a larger width and is provided with three magnets 1. Due to the different numbers of magnets 1, the width of the magnetic conduction plate 2 changes accordingly. FIG. 4 shows a membrane with five pole faces 201 and a loudspeaker 100 with five engine assemblies 10. In this embodiment, the width of each pole face 201, the numbers of magnets 1, and the sizes of the magnetic conduction plates 2 are equal respectively. When the cross section of the membrane 20 is a quadrilateral, the membrane 20 has three pole faces 201; and when the cross section of the membrane 20 is a hexagon, the membrane 20 has five pole faces 201.

Since each pole face 201 is not on the same horizontal plane, but adjoins each other at a specific angle, the membrane 20 can achieve sound radiation in different ranges, and the radiation range of the wavefronts formed by the vibration of multiple pole faces 201 of the membrane 20 can be set according to requirements. For example, the membrane 20 with three pole faces can achieve uniform sound radiation in a range of 180°, and the membrane 20 with more than three pole faces can achieve uniform sound radiation in a range of 360°. In case of a 360° omnidirectional mode, in order to ensure the uniformity of vibration, the sizes of different pole faces 201 of the membrane 20 are set to be the same. For example, the cross section of the membrane 20 shown in FIG. 4 is a regular hexagon. In case of a 180° pointing mode, the sizes of different pole faces 201 of the membrane 20 may be set to be different. For example, the cross section of the membrane 20 shown in FIG. 3 is a non-parallelogram with three pole faces.

Specifically, as shown in FIG. 3, the cross section of the membrane 20 is a quadrilateral and has three pole faces 201. The pole faces 201 include three irregular pole faces connected in sequence, i.e., a first pole face 2011, a second pole face 2012, and a third pole face 2013. In the quadrilateral cross section, the side of the membrane 20 which corresponds to the back plate is a signal connection part of the membrane 20. The audio signal is input from a current input interface on the side of the back plate 103, and pushes the membrane 20 to vibrate from the signal connection part of the membrane 20. The first pole face 2011, the second pole face 2012 and the third pole face 2013 respectively vibrate to generate plane waves spreading in different directions, and the plane waves in different directions can be coupled to form a multipole coupled plane wave. Since the membrane 20 has three pole faces 201, correspondingly, three engine assemblies 10 are provided in the membrane 20 formed by the enclosure.

As shown in FIG. 4, in this embodiment, the engine assembly 10 includes a magnet 1 and a magnetic conduction plate 2, and the membrane 20 includes five pole faces 201 of the same size. The five pole faces 201 with different angles are connected in sequence to form a membrane 20 with a regular hexagon cross section by enclosure. Correspondingly, five engine assemblies 10 are arranged in the membrane 20 formed by the enclosure. The audio signal is input from the current input interface on the side of the back plate 103 (the second cylindrical surface) to the signal connection part of the membrane 20, and the five pole faces 201 respectively generate electromagnetic induction in the magnetic field of the five engine assemblies 10 corresponding thereto, thereby driving each pole face 201 to vibrate and emit a sound. With the use of five pole faces 201 with different angles, two adjacent pole faces 201 are coupled in a diffusion manner at an included angle greater than or equal to 120° and point to a different space, which expands the radiation range of the wavefronts formed by the vibration of the membrane 20.

If the engine assemblies 10 use the magnets 1 alone, it is easy to generate magnetic leakage, and the magnets 1 in different planes will generate stray magnetic fields, which will interfere with the magnetic fields of different planes. Therefore, adding the magnetic conduction plate 2 to the periphery of the magnet 1 can not only increase the magnetic force, but also shield the magnetic field interference of the loudspeaker 100. The U-shaped semi-enclosed structure of the magnetic conduction plate 2 can prevent the interference of magnetic leakage and stray magnetic fields, and shield the magnetic field interference of the loudspeaker 100. In addition, the magnetic conduction plates 2 are quick and convenient to assemble, and can ensure that the magnets 1 are adhered firmly.

The independent engine assemblies 10 inside each pole face 201 of the membrane 20 are superimposed in a distributed array to form a multipole engine array system. The magnetic field formed by the engine assemblies 10 composed of the magnets 1 and the magnetic conduction plates 2 is an isomagnetic plane magnetic field, and the magnetic field formed by the multipole engine array system is a multipole magnetic field. In a specific implementation, the number and arrangement of the engine assemblies 10 are designed according to the power of the loudspeakers, the strength of the magnetic force, the inductive strength of the circuit, and the specific purpose of the membrane (for example, for tweeter, mid-range, or mid-and-tweeter combined loudspeakers).

The magnet 1 in each engine assembly 10 may be a single magnet or a composite magnet composed of multiple single magnets. The number of pole faces 201 of the membrane 20, the size of each pole face 201, and the size of the cylindrical cross-sectional diameter of the entire loudspeaker 100 directly determine the three-dimensional sizes and number of the magnets 1, and also determine the efficiency of the loudspeaker 100. The larger the horizontal size or area of the pole faces 201 is, the larger the space for placing the magnets 1 and the greater the number of the magnets 1 will be.

Figure 5:
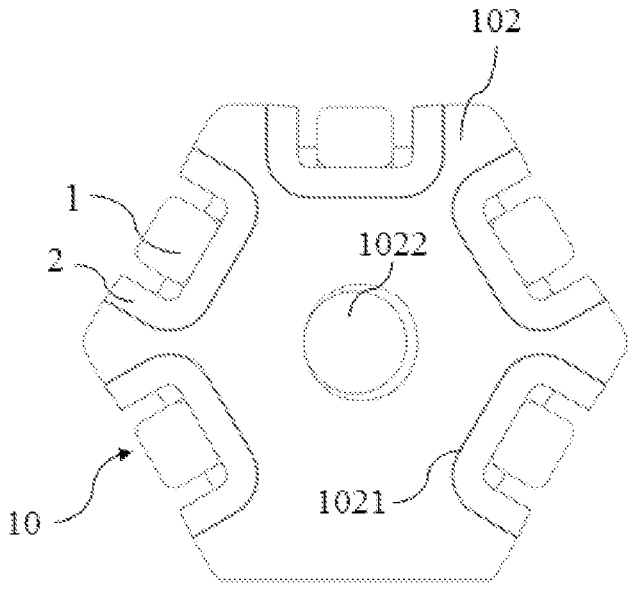
FIG. 5 is a schematic view of an array of a multipole engine array system composed of single-magnet engine assemblies and provided by an embodiment of the present disclosure.
Figure 7:
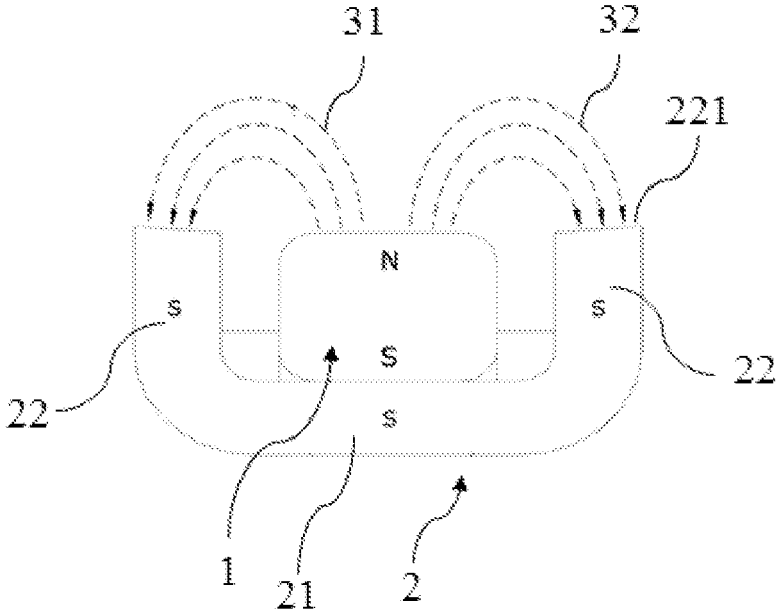
FIG. 7 is a schematic view of a magnetic circuit of a single-magnet engine assembly provided by an embodiment of the present disclosure.
Figure 8:
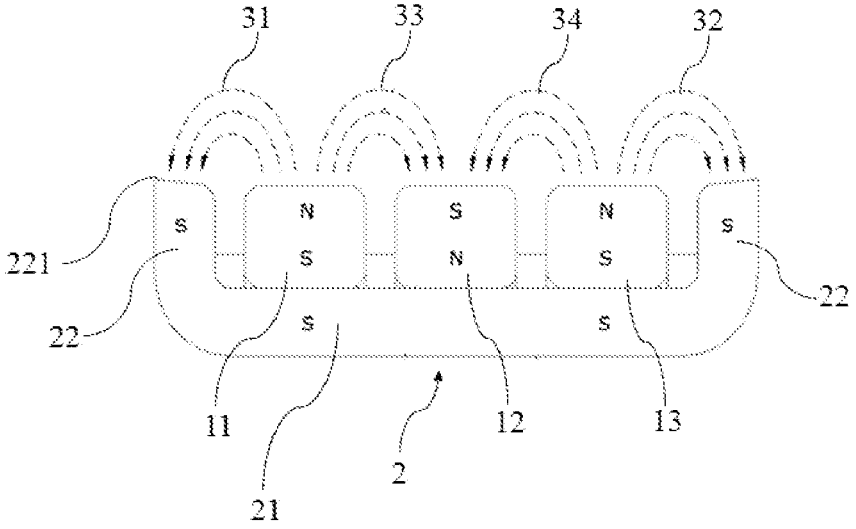
FIG. 8 is a schematic view of a magnetic circuit of a composite-magnet engine assembly provided by an embodiment of the present disclosure.

With reference to FIGS. 5 and 7, the magnetic pole directions of the magnets 1 and the magnetic conduction plates 2 are shown in FIG. 7. The engine assembly 10 composed of a single magnet includes a U-shaped magnetic conduction plate 2 and a magnet 1 arranged in the magnetic conduction plate 2. The N pole of the magnet 1 faces up, and the S pole thereof faces down. A first end face (a lower end face) of the magnet 1 is attached to the bottom plate portion 21 of the magnetic conduction plate 2, and a magnetic circuit is formed between the magnet 1 and the magnetic conduction plate 2. The electromagnetic induction force formed by the membrane 20 in the magnetic circuit can push the membrane 20 to vibrate and emit a sound. The magnetic conduction plate 2 can conduct the S magnetic pole of the magnet 1 through the bottom plate portion 21 to the extending portions 22 located on both sides of the bottom plate portion 21. The magnetic lines of force from the N pole of the magnet 1 reach the extending portions 22 located on left and right sides of the magnetic conduction plate 2 respectively, and then return to the S pole of the magnet 1 to form a first magnetic circuit 31 and a second magnetic circuit 32 as shown in FIG. 8. The heights of the end faces 221 of the extending portions 22 on the left and right sides of the magnetic conduction plate 2 are approximately the same as the height of the magnet 1 (the distance between the N pole and the S pole of the magnet 1). The magnetic field formed by the first magnetic circuit 31 and the second magnetic circuit 32 is an isomagnetic plane magnetic field.

Figure 6:
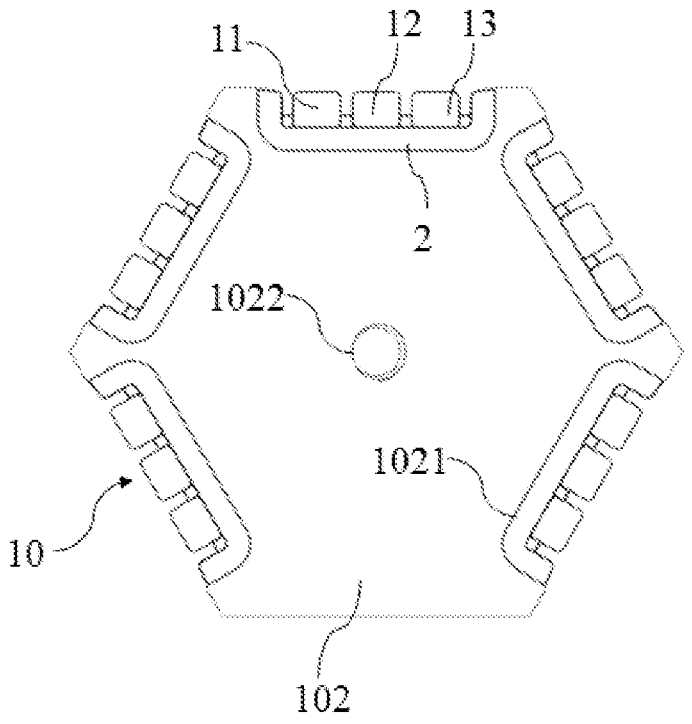
FIG. 6 is a schematic view of an array of a multipole engine array system composed of composite-magnet engine assemblies and provided by an embodiment of the present disclosure.

With reference to FIGS. 6 and 8, the magnetic pole directions of the magnets 1 and the magnetic conduction plate 2 are shown in FIG. 8. The engine assembly 10 composed of a composite magnet includes a U-shaped magnetic conduction plate 2 and a plurality of magnets 1 arranged in the U-shaped magnetic conduction plate 2. The plurality of magnets 1 are arranged at a certain interval in the magnetic conduction plate 2, and the magnetic pole directions of adjacent magnets 1 are opposite. In this embodiment, three magnets 1 are provided in the magnetic conduction plate 2. The N poles of the first magnet 11 and the third magnet 13 near the inner walls on both sides of the U-shaped magnetic conduction plate 2 face up, and the S poles thereof face down; the S pole of the second magnet 12 in the middle position of the magnetic conduction plate 2 faces up, and the N pole thereof faces down. The magnetic conduction plate 2 guides the S magnetic poles of the first magnet 1 and the third magnet 13 to the extending portions 22 on left and right sides of the magnetic conduction plate 2 respectively to form a first magnetic circuit 31 and a second magnetic circuit 32 as shown in the figure, and a third magnetic circuit 33 and a fourth magnetic circuit 34 are respectively formed among the three adjacent magnets 1 with opposite magnetic pole directions, which enhances the magnetic induction intensity. The end faces 221 of the extending portions 22 on both sides of the magnetic conduction plate 2 and second end faces (upper end faces) of the magnets 1 are approximately on the same horizontal plane, and the end faces 221 are inclined inward at a certain angle to reduce magnetic leakage.

In the engine assembly 10 composed of a composite magnet, as the number of magnets 1 increases, the number of magnetic circuits also increases, and N+1 magnetic circuits can be formed by the N magnets 1 and the magnetic conduction plate 2. The magnetic conduction plate 2 will guide the magnetic poles of back sides (sides attached to a bottom surface of the magnetic conduction plate 2) of the two magnets 1 nearest to the edges on the left and right sides to the edges and front sides of the magnets 1 (sides close to the membrane 20) to form N+1 magnetic circuits. In a specific implementation, the number of magnets 1 is generally an odd number, so that the magnetic pole directions of the magnets 1 located at the left and right ends of the magnetic conduction plate 2 are the same, and the magnetic poles conducted to the extending portions 22 on the left and right sides of the magnetic conduction plate 2 are the same, thus enabling a magnetic circuit to be better formed in combination with the magnetic conduction plate 2. The engine assembly 10 composed of a composite magnet can increase the number of magnetic circuits, place the membrane 20 in a stronger magnetic field, and provide stronger electromagnetic induction force for the vibration of the membrane 20.

During the assembly process of the engine assembly 10, the magnets 1 are magnetized in advance, and then the magnets 1 are glued and assembled on the magnetic conduction plate 2. In addition, since the magnetic conduction plate 2 is a magnetic conductor, it will be actively attracted by the magnets 1. The magnets 1 are likely to be bumped and broken during the assembly process. In order to reduce the assembly difficulty, an axial size of the magnet 1 needs to be limited within a certain range. If the height size of the loudspeaker 100 is relatively large, a plurality of magnets 1 with relatively small axial sizes may be connected in parallel up and down. In a preferred implementation, the magnets 1 are N50 or higher-grade neodymium-iron-boron magnets, which can provide a stronger magnetic field, and the sizes of the magnets 1 can be smaller; the magnets 1 may also be made of other permanent magnet materials, which are not specifically limited in the present disclosure. If the diameter of the cylindrical section of the loudspeaker 100 is large enough or each independent engine assembly 10 uses a composite magnet, the power and efficiency of the loudspeaker 100 generated by the multipole engine array mode is much greater than other types of mid-range or tweeter loudspeakers.

The housing 101 of the loudspeaker 100 may have a regular or irregular cylindrical structure. When the housing 101 has a regular cylindrical structure, the cross section of the housing 101 may be circular, elliptical, quadrilateral, or the like.

The present disclosure can form a multipole magnetic field enclosed by planes from a single-pole isomagnetic plane magnetic field in a multipole manner, so that each pole face of the membrane with multiple pole faces respectively radiates sound waves with a controllable power to a 360° or an arbitrarily settable angle space in a manner of multi poles with different angles, thereby realizing the ability of complete diffusion of the spatial distribution of sound waves. As compared with a single-pole engine, the multipole engine array system composed of a plurality of engine assemblies 10 can drive the membrane 20 to vibrate to form more audio information, and can perform high-power resolution on the sound, thereby achieving a super resolution ability on the sound. Since the multipole isomagnetic plane magnetic field generated by the magnetic circuit structure of the multipole engine array can uniformly push the induction membrane, there is no distortion and delay caused by the transition of the membrane of traditional moving-coil loudspeaker from the center of the voice coil connection part to the edge, which reduces the group delay of the loudspeaker, and makes the response speed faster.

The multipole engine array system can perform high-power resolution on audio signals and in-depth restoration of dynamic details, and the spatial array distribution of the multiple engine assemblies 10 enables complete diffusion of sound waves. Since the circuit between each pole face 201 of the membrane 20 is a through path and each pole face 201 has a matching independent engine assembly 10, after receiving the same audio signal at the same time, each pole face 201 will generate a series of complicated vibrations over time.

Figure 9:
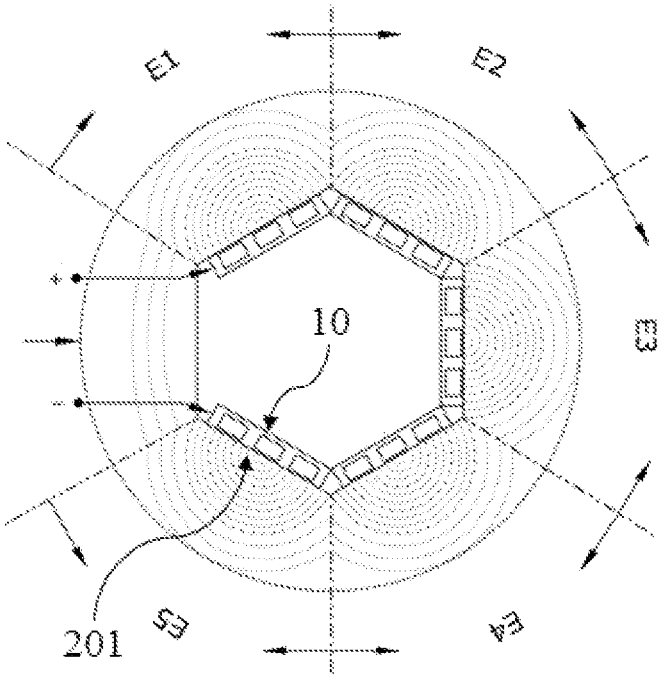
FIG. 9 is a schematic view of Fourier transform analysis of a multipole engine array system provided by an embodiment of the present disclosure.

Specifically, in an embodiment, the audio resolution of the multipole engine array system provided by the present disclosure is analyzed according to the principle of Fourier transform. Specifically, according to the principle of particle motion and Fourier transform, if a full-frequency signal is accessed, the signal generated is a composite wave after synthesis from the perspective of frequency domain, and the signal generated is the sum of the particle motions from the perspective of time domain. If the principle of Fourier resolution is further used to resolve this composite wave or the sum of particle motions, multiple simple waves will be obtained, wherein the fluctuation of each simple wave and the displacement of particle in each element section can be understood as a simple harmonic vibration following the sine or cosine function. The present disclosure is formed by a plurality of independent engine assemblies 10 through a distributed array of pole faces, which is equivalent to a plurality of traditional single-engine loudspeakers working together. That is, the signals of the same channel are superimposed for multiple times in fluctuation mode of frequency domain and time domain according to the principle of Fourier transform, and finally the electrical-force-acoustic conversion process is completed. The complete fluctuating state completed by multiple engine pole faces together can be expressed as: $\Sigma E=E_1+E_2+\ .\ .\ .\ +E_n$ or $\Sigma E=E\times n$, where $\Sigma E$ represents the superposition or multiplication of all engine assemblies of the loudspeaker, E represents a single engine assembly, and n is the number of engine assemblies (pole faces)). As shown in FIG. 9, "+" in the figure represents the current input, and "−" represents the current output. The five independent engine assemblies 10 are in a regular hexagonal array, driving the different pole faces 201 of the membrane 20 closely attached to them to vibrate. The resolutions of five engine assemblies 10 $E_1$ to $E_5$ can be obtained separately, and the resolution of all engine assemblies 10 can be obtained by superimposing or multiplying the five different resolutions, which can perform in-depth and detailed resolution on the audio signals. In addition, the sound wave radiation direction generated by the driving of each pole face 201 is different, and multiple sound waves are superimposed or coupled with each other, so that the sound waves can achieve a 360° omnidirectional radiation diffusion.

In another embodiment, the Shannon formula can be used to analyze the audio resolution of the loudspeaker. For ease of understanding, an equivalent analog is first made between the related terms of Shannon's information theory and the related terms of acoustics.

Channel: which can be analogous to the audio channel of the signal, that is, the audio signal (audio channel) connected into the circuit of the loudspeaker. Generally, only one audio signal is connected into one traditional loudspeaker, and there is only one channel. However, the multiple engine assemblies 10 of the present disclosure split the same channel into multiple channels with the same number as the engine assemblies 10.

Bandwidth: which can be analogous to frequency width, that is, the difference between the highest frequency and the lowest frequency of the frequency components contained in the signal. The bandwidth is proportional to the capacity, has a unit of Hz, and is represented by H in the formula.

Velocity: which can be analogous to the ratio of the wavelength $\lambda$ through which the particle displacement passes and the time t of passing through this wavelength $\lambda$, wherein $v=\lambda/t$. The velocity is not equal to speed, but is proportional to speed. The frequency of the sound wave is determined by the sound source that produces the sound, and does not change with the change of the medium in which the sound is propagated. Therefore, the sound waves of different frequencies have different propagation velocities in the same medium. The lower the frequency is, the larger the wavelength and the larger the velocity will be; and the higher the frequency is, the smaller the wavelength and the smaller the velocity will be. In acoustics, the velocity is more affected by the low frequency end of the bandwidth.

Error rate: which can be equivalent to distortion rate.

The Shannon formula $C=H\log_2(1+S/N)$ shows that the information capacity C is directly proportional to each of the channel, the bandwidth H, and the velocity v, but the error rate is inversely proportional to the information capacity C, the channel, and the bandwidth H, and is directly proportional to the velocity v. S/N is the signal-to-noise ratio, wherein S is the signal power (watts), and N is the noise power (watts); the information capacity C is the maximum transmission capacity of the channel. If the information source velocity R of the channel is less than or equal to the channel capacity C, then theoretically, the output of the information source can be transmitted through the channel with an arbitrarily small error rate.

In this embodiment, the velocity v is equivalent to the ratio of the wavelength to the unit time, the channel capacity C is equivalent to the frequency width H, and the error rate is equivalent to the distortion rate (DR); in order to reduce the distortion, the frequency width H can be increased or the velocity v can be reduced. If the frequency width H and the velocity v increase at the same time or only one of them increases, the amount of information passing through the channel will also inevitably increase; and if the frequency width H decreases at the same time or only one of them decreases, the amount of information passing through the channel will also inevitably decrease. Since the channels of the multipole engine array system of the present disclosure are in a multi-point distributed array mode, when the number of channels is greater than or equal to 2, the overall amount of information and the channels are superimposed in an array.

Figure 10:
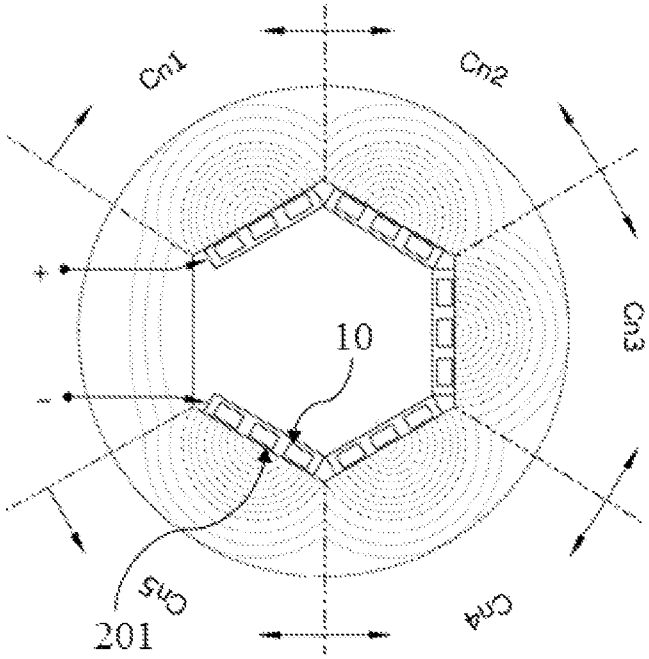
FIG. 10 is a schematic view of Shannon formula analysis of a multipole engine array system provided by an embodiment of the present disclosure.

As shown in FIG. 10, five independent engine assemblies 10 are in a regular hexagonal array, driving the different pole faces 201 of the membrane 20 closely attached to them to vibrate. When the same audio signal is accessed, the channels are split into $C_{n1}$ to $C_{n5}$ sub-channels. According to the Shannon formula, the total information capacity can be expressed as $\Sigma C=H\log_2(1+S/N)\times cn$, where $\Sigma C$ is the sum of the information passing through all the channels, H is the frequency width, and the lowercase cn is the number of channels superimposed in an array. If the signal-to-noise ratio S/N is ignored, the formula can be simplified as $\Sigma C=H\times cn$, that is, the sum of the information passing through all the channels is equal to the bandwidth multiplied by the number of channels. This formula can be equivalent to the formula obtained through the Fourier transform above: "$\Sigma E=E_1+E_2+\ldots+E_n$ or $\Sigma E=E\times n$", that is, the sum of all engine assemblies is equal to the superposition or multiplication of individual engine assemblies.

The analysis of the audio resolution of the loudspeaker using the Shannon formula shows that the use of the multipole engine array system can drive the membrane 20 to form more information capacity C at the same time, while also making the information capacity C and the frequency width H of the loudspeaker controllable, which can improve the ability of resolving the audio signals of the loudspeaker 100 and the ability of controlling the loudspeaker. The audio information capacity C is allowed to be split to a horizontal three-dimensional space pointed to by the multiple pole faces 201 of the membrane 20. The energy release space is centered on the physical position of the loudspeaker 100 itself, and is larger or wider than that of a traditional single-engine loudspeaker. Under the condition of ensuring that the frequency width in the direction perpendicular to each pole face 201 is not affected, the horizontal pointing angle and efficiency of each pole face 201 can be controlled.

Figure 11:
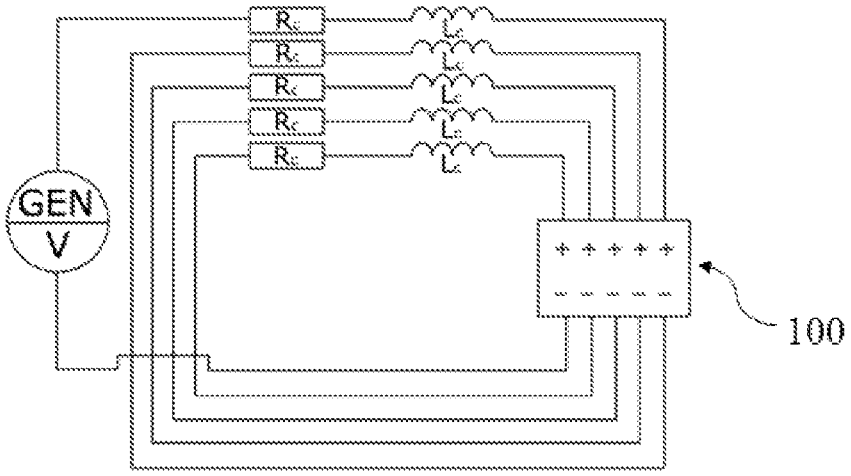
FIG. 11 is a schematic view of an equivalent circuit model of a multipole engine array system provided by an embodiment of the present disclosure.

In yet another embodiment, the audio resolution of the loudspeaker is analyzed in the way of equivalent circuit modeling, and lumped parameters of the electrical-force-acoustic conversion process are integrated in the way of circuit model to form an equivalent circuit model. In this way, mechanical (force) and acoustic (sound) parameters can be converted into electrical (electric) parameters, which are displayed and calculated in the form of reactance in the circuit. The reactance in the equivalent circuit model includes resistance $R_E$ (impedance) and inductance $L_{VC}$ (inductive reactance). As shown in FIG. 11, a multipole engine array system composed of five independent engine assemblies 10 is taken as an example for illustration. In the figure, $R_C$ is the resistance of the induction membrane, $L_C$ is the inductance of the induction membrane, and GEN is the power supply. The connection of the five independent engine assemblies 10 to the loudspeaker 100 through the circuit is similar to five independent equivalent circuit connections. As compared with a single engine system, multiple independent equivalent circuit connections can perform different resolutions on the audio signals, improve the ability of high-power resolution on the original audio signals, and improve the performance of the loudspeaker.

In the multipole engine array system of the present disclosure, since individual engine assemblies are independent from each other, and they cooperate to push the different pole faces of the membrane closely connected to them to vibrate, so that colorful sounds can be resolved, thereby achieving high-power resolution on audio signals, in-depth restoration of dynamic details, and complete diffusion of the spatial distribution of sound waves.

The present disclosure also provides a loudspeaker including the above-mentioned multipole engine array system. The loudspeaker is a tweeter loudspeaker and/or a mid-range loudspeaker. The loudspeaker also includes a cylindrical housing, which has a cylindrical structure or an elliptical cylindrical structure. Since the wavefronts of the sound waves radiated by the loudspeaker in the air are cylindrical waves, a pure linear array can be generated, so the loudspeaker provided by the present disclosure is suitable for a linear sound source system.

When the loudspeaker is applied to a linear sound source system, the center of the mounting seat 102 of the loudspeaker 100 is provided with a through hole 1022 that can penetrate the upper and lower ends of the mounting seat 102. The through hole can connect a plurality of different loudspeakers 100 together in an array. Cylindrical waves generated by the plurality of loudspeakers 100 in the air by radiation can form a line array.

It should be pointed out that in the description of the present disclosure, terms "install", "connect" and "connection" should be understood in a broad sense. For example, the connection may be an internal communication between two elements, may be a direct connection, or an indirect connection implemented through an intermediate medium, or it may be an electrical connection or a signal connection.

For those skilled in the art, the specific meaning of the above terms can be understood according to specific circumstances.

It should be pointed out that in the description of the present disclosure, terms "first" and "second" are only used to distinguish one entity or operation from another entity or operation, and it is not necessarily required or implied that there is any such actual relationship or order between these entities or operations.

Described above are only specific embodiments of the present disclosure, but the scope of protection of the present disclosure is not limited to this. Any change or replacement that can be easily conceived by those skilled in the art within the technical scope disclosed in this document should be covered within the scope of protection of the present disclosure. Therefore, the scope of protection of the present disclosure shall be accorded with the scope of the claims.

The invention claimed is:

1. A multipole engine array system, which is applied to a cylindrical loudspeaker, wherein the multipole engine array system comprises a plurality of engine assemblies distributed in an annular array, the plurality of engine assemblies are fixed inside the cylindrical loudspeaker through a mounting seat arranged in a housing of the cylindrical loudspeaker, each of the engine assemblies comprises a magnetic conduction plate and a magnet arranged in the magnetic conduction plate, a magnetic field is formed between the magnet and the magnetic conduction plate, and the plurality of the engine assemblies are arranged coaxially and annularly along a periphery of the mounting seat to form a multipole magnetic field with multiple magnetic pole directions.

2. The multipole engine array system according to claim 1, wherein the plurality of the engine assemblies are separated from one another, and magnetic pole faces of the plurality of the engine assemblies are on different planes respectively.

3. The multipole engine array system according to claim 2, wherein the magnetic conduction plate is a U-shaped magnetic conduction plate, at least one said magnet is arranged in the magnetic conduction plate, and a U-shaped opening of the magnetic conduction plate faces a membrane of the cylindrical loudspeaker; an end face of one end of the magnet is attached to a U-shaped bottom surface of the magnetic conduction plate, and an end face of the other end of the magnet corresponds to an inner surface of the membrane at a certain distance; and wherein there is a certain gap between the magnet and inner walls of extending portions on both sides of the magnetic conduction plate, and the magnetic field formed between the magnet and the magnetic conduction plate is an isomagnetic plane magnetic field.

4. The multipole engine array system according to claim 3, wherein one said magnet can form two magnetic circuits with the magnetic conduction plate, and N said magnets can form N+1 magnetic circuits with the magnetic conduction plate.

5. The multipole engine array system according to claim 3, wherein the mounting seat is of a polygonal prism structure, and comprises a plurality of first cylindrical surfaces provided with the membrane and a second cylindrical surface not provided with the membrane; the membrane surrounds the periphery of the mounting seat to form a polygonal prism-like membrane with a plurality of pole faces, the engine assemblies are installed between the first cylindrical surfaces and a back side of the membrane, the first cylindrical surfaces are provided with a U-shaped mounting groove matching the engine assemblies, the back side of the magnetic conduction plate of the engine assembly is attached to the surface of the U-shaped mounting groove, and the magnetic pole faces of the engine assemblies correspond to the back side of membrane.

6. The multipole engine array system according to claim 5, wherein a circuit is printed on the membrane, and the pole faces are connected to each other through the circuit.

7. The multipole engine array system according to claim 6, wherein each of the pole faces is a plane, vibrations of the pole faces of the membrane in different planes can form plane waves spreading in different directions, and the plane waves can be coupled with each other to form a multipole coupled plane wave.

8. The multipole engine array system according to claim 7, wherein a back plate is fixedly installed on the second cylindrical surface, a lead wire interface is provided on the back plate, and the lead wire interface is connected to an input end and an output end of the circuit printed on the membrane respectively.

9. The multipole engine array system according to claim 1, wherein at least three engine assemblies are provided.

10. A loudspeaker, comprising a cylindrical housing and the multipole engine array system according to claim 1 and installed in the cylindrical housing, wherein the loudspeaker is a tweeter loudspeaker and/or a mid-range loudspeaker.

* * * * *